United States Patent [19]

Sommer

[11] 4,067,758

[45] Jan. 10, 1978

[54] METHOD OF FORMING CONSTRUCTIONAL ELEMENTS

[76] Inventor: Charles Sommer, "Les Louvieres", 50, route Nationale, 78.Coignieres par le Mesnil St. Denis, France

[21] Appl. No.: 642,744

[22] Filed: Dec. 22, 1975

Related U.S. Application Data

[63] Continuation of Ser. No. 426,634, Dec. 12, 1973, abandoned.

[30] Foreign Application Priority Data

| | | |
|---|---|---|
| Dec. 15, 1972 | France | 72.44691 |
| May 4, 1973 | France | 73.1607 |

[51] Int. Cl.[2] ..... B32B 7/04

[52] U.S. Cl. ..... 156/91; 156/71; 156/280; 428/77; 428/310; 52/309.7; 52/309.12

[58] Field of Search ..... 404/70, 134; 428/44, 428/310, 77; 52/720, 743, 49, 581, 583, 587, 432; 156/71, 79, 91, 280; D25/80; 220/9

[56] References Cited

U.S. PATENT DOCUMENTS

| | | | |
|---|---|---|---|
| 95,622 | 10/1869 | Whipple | 245/5 |
| 519,928 | 5/1894 | Schanek | 245/5 |
| 732,535 | 6/1903 | Firestone | 52/581 |
| 1,894,932 | 1/1933 | Venzie | 52/432 |
| 2,078,485 | 4/1937 | Dunham | 404/70 |
| 2,160,773 | 5/1939 | Wolfe | 52/587 |
| 3,122,073 | 2/1964 | Masse | 52/515 |
| 3,389,518 | 6/1968 | Horbach | 52/746 |
| 3,655,086 | 7/1972 | Trenner | 220/9 |

*Primary Examiner*—William J. Van Balen
*Attorney, Agent, or Firm*—Darby & Darby

[57] ABSTRACT

A method of forming a construction member by first froming a plurality of elements by superimposing and bonding together a plurality of sheets of plastic foam material, each in the range of from about 10 mm to about 25 mm thick, to form a laminate and attaching a wire mesh reenforcing member to a face of the laminate with parts of the mesh extending over the edge of the laminate. A plurality of the elements are placed adjacent one another and the extending portions of the mesh are connected. A continuous layer of mineral hydraulic material in then placed over the faces of the element to form the construction member.

8 Claims, 20 Drawing Figures

Fig. 10
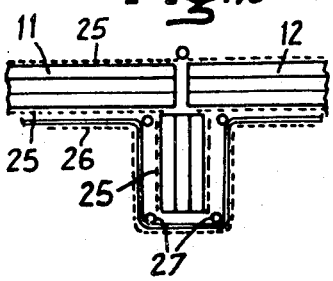
Fig. 11
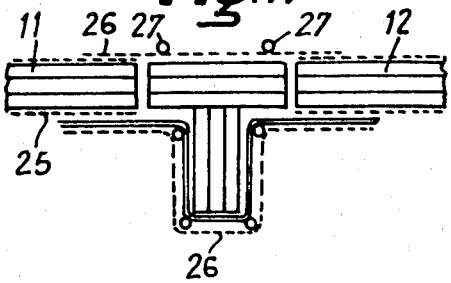
Fig. 12
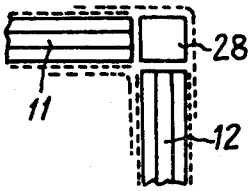
Fig. 13
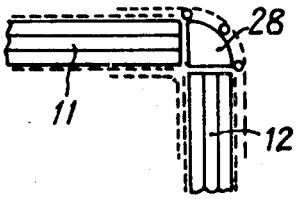
Fig. 14
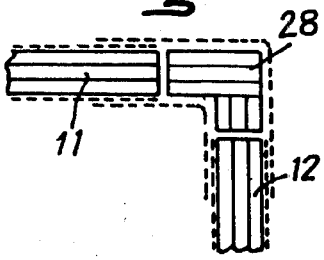
Fig. 15
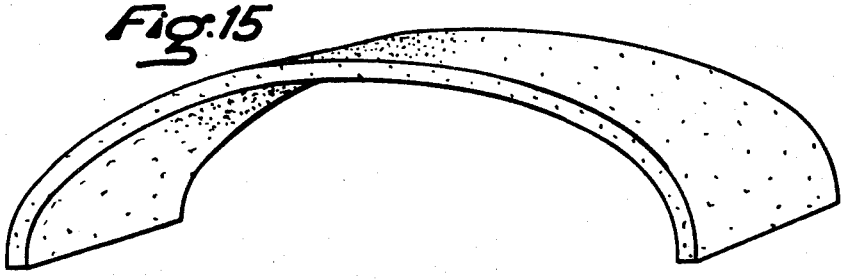
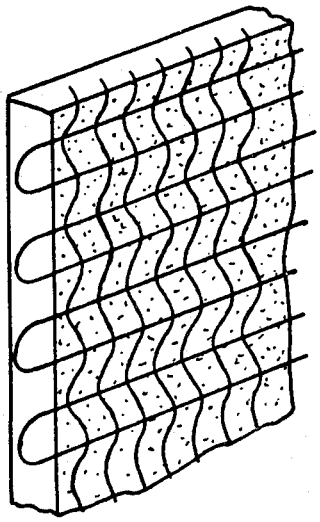
Fig. 16

METHOD OF FORMING CONSTRUCTIONAL ELEMENTS

This is a continuation, of application Ser. No..426,634, filed Dec. 12, 1973, now abandoned The invention relates to constructional elements and method of forming such elements.

The constructional elements are intended to be manufactured in a factory or on site for the building of constructions.

In accordance with one feature of the invention there is provided a constructional element for use in forming a construction wall or the like, comprising a laminate structure having a plurality of sheets of insulating material and presenting two opposed outer faces, and reinforcing means adhered to at least one of said faces of said laminate structure and partially projecting from said element, whereby the reinforcing means of said element can be connected to a reinforcing means of a similar element to form a continuous reinforcement.

In accordance with another feature of the invention there is provided a method of forming a construction wall or the like, comprising the steps of laminating a plurality of sheets of insulating material to form a laminate structure having opposed outer faces, adhering a metal reinforcing means to at least one of said faces to form a constructional element from which said reinforcing means partially projects, assembling a plurality of said constructional elements together by connecting said reinforcing means of contiguous elements to provide a continuous reinforcement, and applying a setting material on to said continuous reinforcement to embed said reinforcement.

Figure 1:
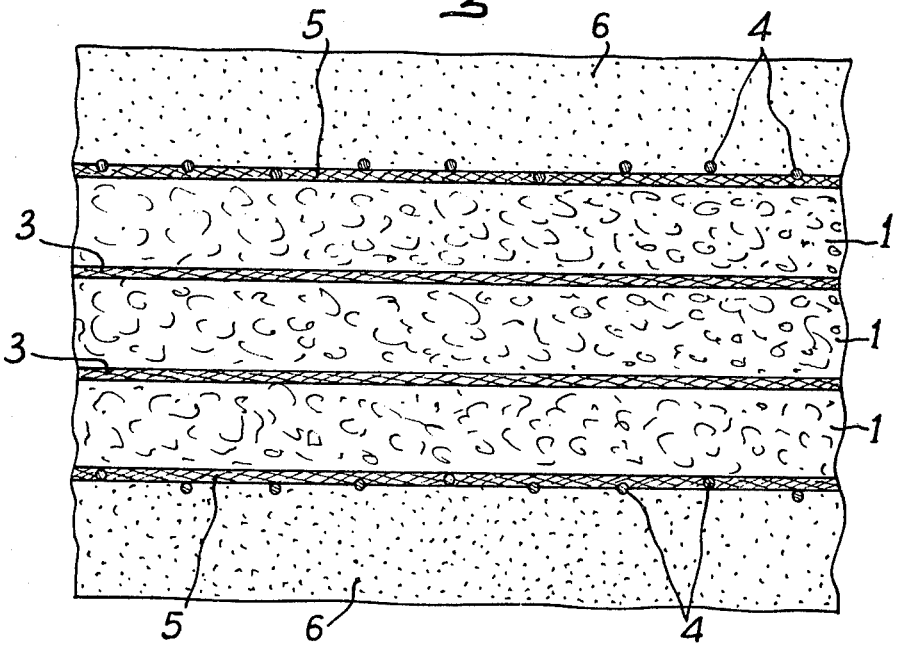
Figure 3:
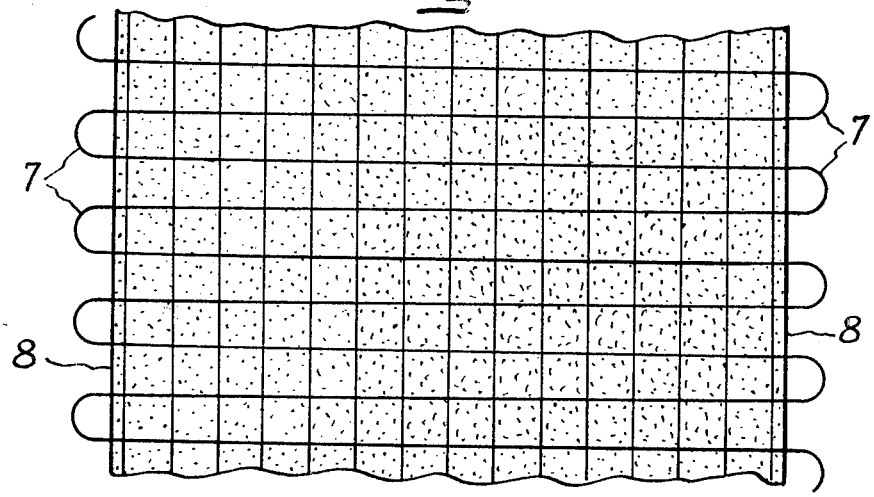
Figure 4:
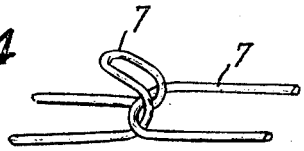
Figure 2:
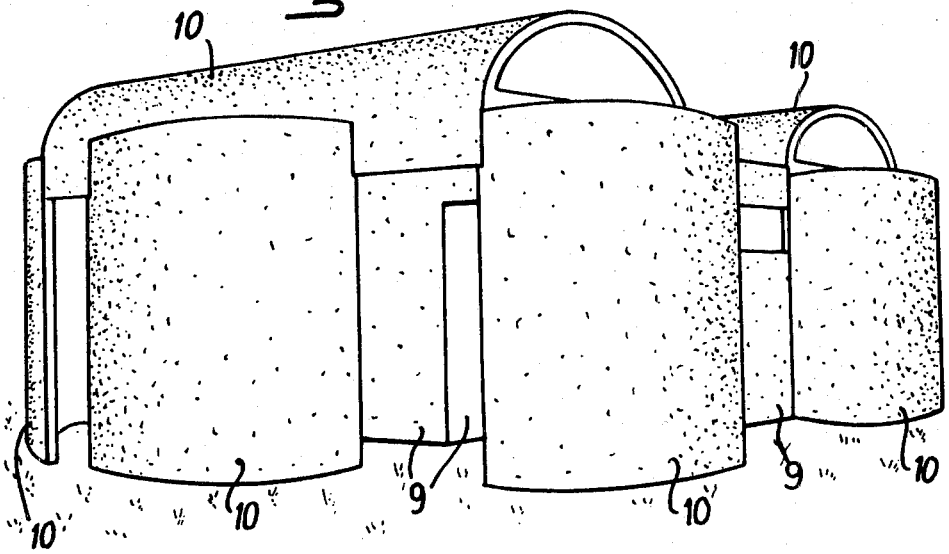
Figure 17:
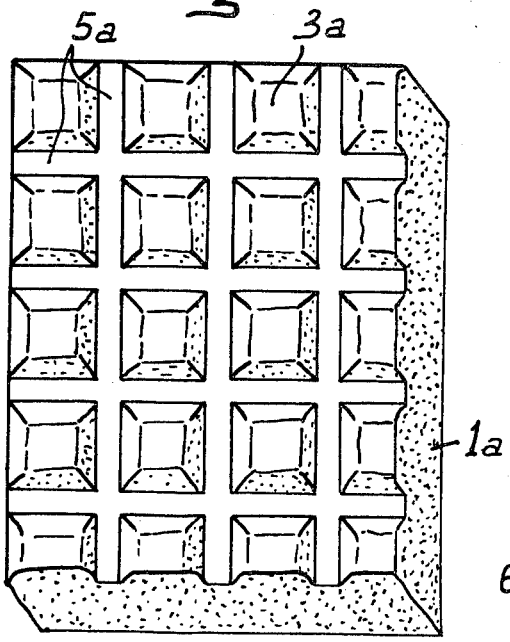
Figure 18:
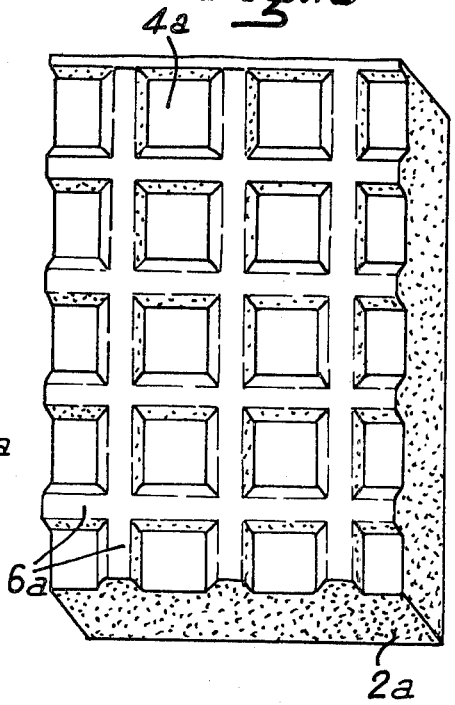
Figure 19:
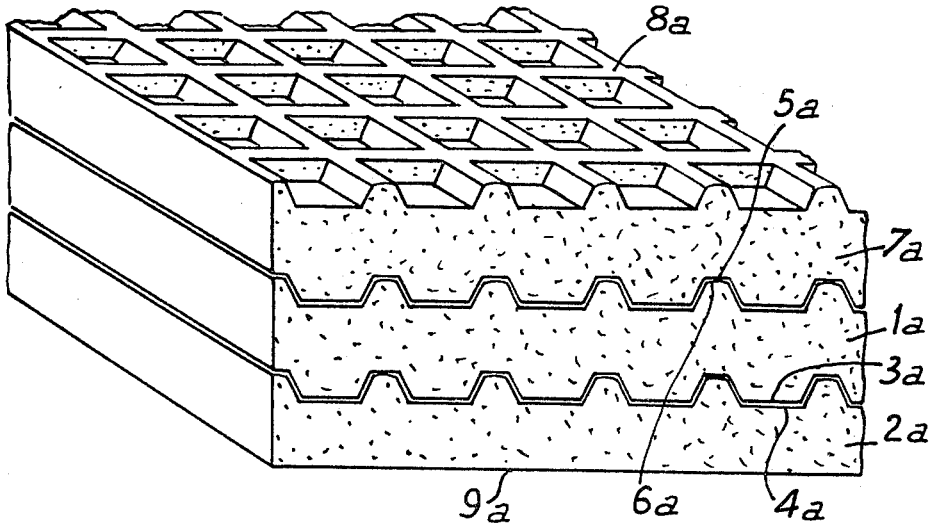
Figure 20:
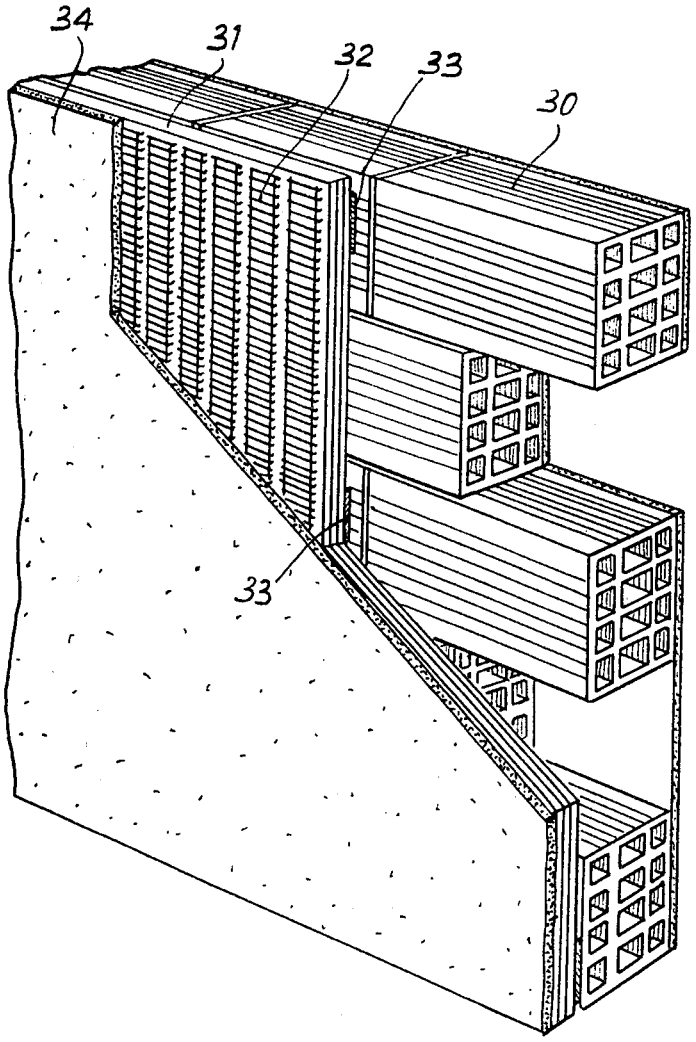

Several constructional elements in accordance with the invention will now be described by way of example with reference to the accompanying drawings, in which:

FIG. 1 is a cross-sectional of a finished construction wall,

FIG. 2 is a perspective view showing a construction formed from constructional elements, FIG. 3 is a plan view of a constructional element forming part of the wall of FIG. 1, FIG. 4 is a detail showing the connection of reinforcements of two constructional elements of FIG. 3, FIGS. 5 to 14 are sectional details showing different forms of finished construction walls, FIG. 15 is a prespective view of a construction wall, FIG. 16 is a partial perspective view showing a modification of a constructional element, FIGS. 17 and 18 are partial perspective views showing sheets of material provided with complementary embossments for forming constructional elements, FIG. 19 is a partial perspective view of a constructional element using the sheets of FIGS. 17 and 18 and FIG. 20 is a perspective view with a portion cut away of a wall portion having constructional elements.

With reference to FIG. 1 constructional elements are formed on site or preferably in a factory by laminating together sheets 1 of a material, such as expanded plastics for example, polyurethane, polystyrene, phenolic foam or any other suitable insulating material of suitable shapes and dimensions preferably by means of a cement which is adherent to plastics materials.

Sheets 1 may be of a material which has a base of glass fibres, expanded glass beads, asbestos, vermiculite, perlite, expanded clay or a composite material with a base of expanded plastics material and a filler which is expanded or otherwise (glass fibres, expanding glass beads, etc.)

The different sheets may consist of the same material or different materials. For example, sheets with a glass felt base could be alternated with plastics foam sheets (polystyrenes, polyethylenes, phenolic foams).

At least one of the sheets of insulating material may be an air-space, which may be formed by providing studs or strips forming spacers between two sheets of solid insulating material.

Then, to at least the or one exterior face of the laminated product obtained, preferably also by means of special cement 5, is fixed a metal reinforcing means 4 in such a way that it remains partially visible or projecting as shown at 7 in FIG. 1 or 3. The reinforcing means preferably takes the form of a rectantular mesh made of wire section of the order of 1–3 mm.

The constructional elements so formed may be used to construct panels, caissons, arches, modular wall elements or ossature elements, and are placed in position in the construction and reinforcing means 4 of the adjacent elements are interconnected so as to form a continuous reinforcement. This could be done, for example, by means of pins or clips or as shown in FIGS. 3 and 4 by bending laterally projecting portions of the adjacent metal armatures.

A mortar with a base of hydraulic binder (or other setting material) is then sprayed on to the reinforcements so as to form a thick coating 6 embedding the meshes 4 and forming a monolithic envelope or construction with a continuous reinforcement.

An example of finished construction using the constructional elements is shown in FIG. 2. In this example the constructional elements are formed into flat panels positioned side by side, end to end, or at right angles, and tubular elements, the section of which may be semi-elliptical.

The flat constructional elements and the tubular sections have been juxtaposed and superimposed and their reinforcements 4 have been joined along the whole length of their contacting edges, and then the thick motar coating 6 has been formed by gun spraying over all the visible faces of the constructional elements. The finished construction is thus effectively a unitary structure the walls of which have a shell comprising a double wall of mortar and a double continuous reinforcement and enclosing a core of several sheets of insulating plastics material.

Very high strengths and rapid, easy and inexpensive construction are thus obtained with a high degree of thermal insulation, although the thickness of the walls may be relatively small and the weight of the construction may be very low.

As an example, the total thickness of a wall such as shown in FIG. 1 may be of the order of 10 to 12 cm of which 4 to 6 cm consists of insulating plastics foam sheet. Its weight per square meter is similar to that of a screen of concrete 4 to 6 cm thick, which is extremely weak.

The sheets of foam laminated together will preferably be of the order of approximately 10 to 25 mm thick.

It is important that the reinforcing means should be visible or projecting so that they may be rendered continuous when the elements are placed in position by any suitable connecting means or may be locally reinforced by complementary reinforcements and so that the final coating 6 is reinforced.

Furthermore, especially when lamination is effected by means of plastics adherent cements, this arrangement provides greater sound insulation for certain wavelengths than would be provided by a single thickness of foam and the cement may provide a key for the final coating 6.

Also the resistance to heavy shocks and cracking of the final coating 6 which may result therefromis very much improved.

Several known cements may be used as the plastics adherent cement, such as plastics with added sugars (especially on the interior) or cements such as that known by the trade mark DRESCEL. However, although special cements are preferred the plastics sheets could be laminated together by other types of binders which could be of a mechanical nature.

The reinforcing means are preferably light-weight for example a metal lattice-work with a preferably rectangular mesh of approximately 1 mm or more in section. In the formation of the constructional elements it is advantageous to use a lattice work in which the wires laterally form loops 7 as shown in FIG. 3. These loops are positioned projecting laterally from core 8 of the panel, which enables two continguous elements to be linked by simple insertion of loops 7 into each other, followed by bending one of them back, as shown in FIG. 4. Preferably, the lattice grid has a welded mesh.

As shown in FIG. 16, it is advantageous to use an undulating or deformed lattice having upper and lower peaks so that it is only applied to the face of the plastics core at the lower peaks. Final coating is then more efficient and the lattice work extends into and thus reinforces a greater thickness of mortar, which increases the strength of the assembly.

In modification, not shown, several layers of lattice work may be superimposed and preferably interconnected by pins or the like. The superimposition of lattice-grid layers may be effected in the factory or on site. The advantages of the double-walled shell and plastics core are thus combined with the remarkable inherent strength of thin outer screens of fine concrete 6 with dense grid reinforcement.

In the arrangement shown in FIG. 20, constructional elements 31 are fixed against the outside of wall 30. The elements may have a reinforcing means 32 on the outer face only and are fixed by mortar studs 33, for example. The reinforcing means of the adjacent elements are interconnected and covered with coating 34 as described above. Thus, the constructional elements may, as previously described, be joined to form an insulated wall or they may be applied, as shown in FIG. 20, to an existing wall.

As a modification to the arrangement of FIG. 20 the wall to be covered is coated and constructional elements having reinforcing means on both faces are applied to this coating, so that the inner reinforcing means applied to the wall is buried in and penetrates the coating, and the outer coating is then formed after interconnection of the outer reinforcing means of the constructional elements thus attached to the wall.

Now it is becoming increasingly apparent that the external insulation of constructions is technically more advantageous than interior insulation, in particular for reasons of thermal currents and condensation, and the arrangement of FIG. 20 provides such external insulation.

This continuous connection of the constructional elements is important to avoid any cracking of the coating 6.34 and to provide it both with an internal network and monolithic construction.

Furthermore, at such connections there is no thermal bridge because the continuity of the reinforcements is effected separately for each face.

In a complete construction, as shown in FIG. 2, i.e., when the constructional elements are used for complete construction of walls, it is preferable to provide a reinforcing means on each face of the element. Moreover, it may prove necessary to reinforce at least certain of the elements at least locally or to support them with a network structure.

Various arrangements are provided for this purpose. For example, the reinforcing means of each element may be connected by pins or the like passing through the core of laminar insulating material, the pins being preferably of plastics material to limit thermal bridging effects as much as possible. This arrangement increases the buckling resistance of the elements or their faces (bulge formation). Alternatively, arrangements such as shown in FIGS. 5 to 14 may be used.

Figure 5:
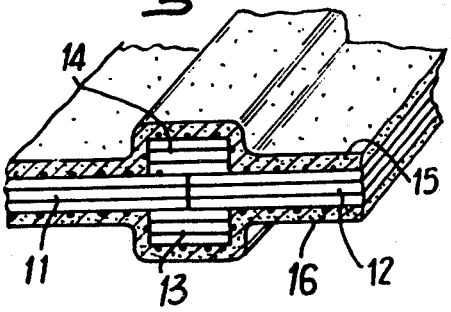

FIG. 5 shows two adjacent elements 11 and 12. At their junction are placed two similar strips 13 and 14 covering the joints and the reinforcing means of elements 11 and 12 are linked with those of elements 13 and 14, for example by means of lattice work strips, to provide reinforcement continuity. The whole is then coated at 15 and 16 with a layer of mortar as described. A strengthening post of rectangular section is thus obtained without breaking the continuity of the insulation.

Figure 6:
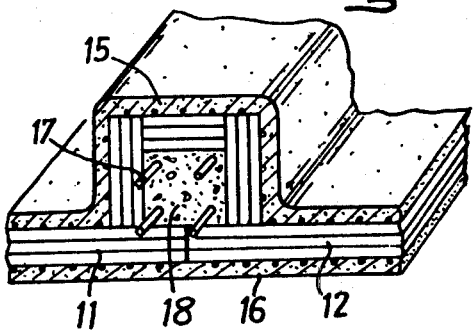

In FIG. 6, a generally U-sectioned constructional element is used. Iron bars or rods 17 are placed inside the U-section and its external reinforcing means is connected to those of panels 11 and 12. After coating at 15 and 16, concrete is poured into the U-section and reinforced by the iron bars 17. A reinforced concrete pillar is thus obtained without interruption of the insulation.

Figure 7:
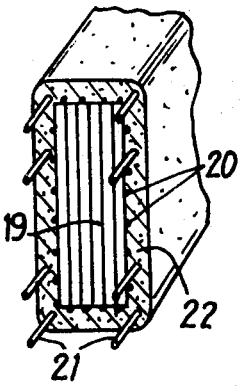

In the example of FIG. 7, a beam or pillar is prepared by coasting a laminar foam core 19 covered by a metal reinforcing means 20. Supplementary iron bars or rods 21 are joined to further reinforcing means 20 and left protruding for subsequent connection. In this case, it may be advantageous to spray coating 22 in two stages, a first thin coat to increase the inherent strength of constructional element 19, 20 and facilitate its handling and installation and a final coat after connection of rods 21 to the other reinforcing means of the construction.

Figure 8:
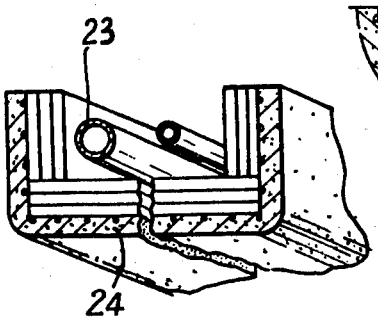

FIG. 8 shows an element 24 of U-section. A casing for pipes 23, for example may be formed using two opposed U-sectional elements.

Flooring may be formed by arranging the U-sectional elements side by side

Figure 9:
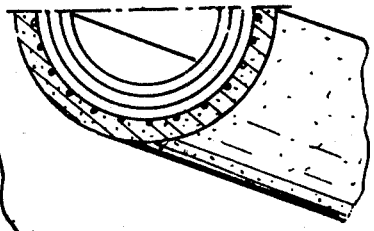

FIG. 9 shows another example of the shapes which can be formed from the constructional elements: a trough element permits formation of columns or cylindrical reinforcements of circular or semi-circular section.

FIG. 10 is a modification of FIG. 5, which may be used to form ceilings or roofs. In this case reinforcing means 25 have been supplemented by a second lattice work 26 in addition to reinforcing rods 27.

A T-section such as shown in FIG. 11 may be used as a post or connection to a cross-wall or as a floor or roof beam.

To avoid any thermal bridge at the angles of the construction expanded plastics angle pieces 28 (FIGS. 12, 13 and 14) may be provided to which are affixed pieces of lattice-work 29 which link the reinforcing means of panels 11 and 12 to be interconnected. These pieses 28 may be of square or rectangular section, with rounded or angled edges. Their own dimensions optionally contribute to modular use of constructional panels 11 and 12.

Formation of the constructional elements by laminating together enables the elements to be given various shapes as is done for plywoods, and in particular surface forms of any genatrix.

One shape of construction panel is shown in FIG. 15 being a section of a surface of which the right section is a semi-ellipse or the like. The major axis of the ellipse may have a length of the order of 2 to 3 m and the half minor axis of the order of 0.80 m to 1 m. The width of the section, along the genatrices is advantageously 0.60 m approximately to permit easy connection of the reinforcing means of the sections used as a cover (see FIG. 2). This width may be greater for example 120 m for elements intended to be set on edge. Such an element may act as a base for the manufacture of constructions such as described in French Pat. No. 70 24768 of 3.7.70 in the name of the applicant.

With reference to FIGS. 17 to 19, it will be seen that two sheets of expanded plastics material 1*a* and 2*a* for forming a constructional element are embossed on their opposed faces 3*a* and 4*a* these embossments having complementary forms so as to be able to interlock as shown in FIG. 19.

The drawing of FIG. 19 shows a portion of constructional with three laminated sheets 1*a*, 2*a* and 7*a* but without the reinforcing means.

The form of the embossing may obviously be very diverse, but in the example shown face 1*a* is imprinted with a grid with a square mesh leaving square based domes 3*a* upstanding, while face 2*a* is imprinted with a network of square slabs 4*a* of the same base, leaving upstanding a grid of square mesh 6*a* with rounded surfaces, while the corresponding grid 5*a* is in depression in FIG. 17.

A lattice of triangular, round or hexagonal elements would give the same results, which is to prevent lateral face on face sliding of sheets 1*a* and 2*a* when they are superimposed with interposition of the adhesive.

Embossement may be obtained by any suitable means, in particular by rolling.

It is advantageous also to emboss at least one of terminal faces 8*a* and 9*a* and in particular those which are intended to receive further metal reinforcing means.

In addition to the advantages of holding the sheets in position during manufacture and of better adherence of the sheets, embossing of the sheets enables a produce to be obtained which has improved sound insulation properties. It would seem that this results from modifications to characteristics caused by the mechanical embossing treatment.

It will be appreciated that the constructional elements formed of the laminate of expanded plastics material covered with metal lattices is easily cut to the required dimensions. It can be cut with a grinding wheel or saw with great ease. As a result, the elements can be cut to the required shapes and dimensions on site. This permits not only the formation of elements as described, but also the cutting out of openings, doors and windows as required. It is not therefore necessary to prefebricate special elements to form openings which is very important, and facings or partitions of completely different appearances may be formed with the same panels without modular restrictions.

The above described wall or construction has all the advantages of strength of a reinforced monolithic wall and which also has remarkable thermal and accessorily sound insulating properties, while employing as an intermediate constructional element which is a very light, inexpensive product, which is easy to work to the required shapes and dimensions and is easy to handle and assemble, and this permits formation of constructions or parts of constructions which are of superior quality and low price.

In particular, the above described process enables existing buildings to be insulated in a particularly practical and economic manner by application to their outer surfaces of a one-piece insulating wall. This possibility becomes yet more advantageous when account is taken today of the disadvantages of interior insulation and of the problem of conveniently effecting exterior insulation.

In the above described construction one of the faces of the elements may be coated with mortar in the factory, continuous joining of the armatures only being effected on one face on site. For certain embodiments the qualities thus obtained may be satisfactory.

Factory prefabrication of construction parts using a plurality of constructional elements is possible. For example for living cells comprising ceiling, floor and exterior walls it may prove advantageous to fabricate the cells and give them the required rigidity by coating the interior faces in the factory. The cells can then be conveyed to the site, placed in position and their external reinforcing means joined and external coating then carried out.

Similarly construction parts without a static role in the construction may be prefabricated in the factory and coated on both faces so as only to have to place them in position on site.

The construction may be made in the most diverse forms, for example by assembly of right parallelepipeds or cylindrical or three-dimensional moulded elements.

I claim:

1. A method of forming a construction member comprising first forming a plurality of elements, the formation of each of said elements comprising the steps of:

a. bonding together in a superimposed relationship a plurality of sheets of plastic foam material each being in the range of from about 10 mm to about 25 mm thick to form a laminate structure, b. attaching a wire mesh type reinforcing means to one outer face of said laminate structure with a portion of the wire mesh extending over at least one of the edges of the laminate and leaving a portion of the mesh exposed, placing a plurality of said elements adjacent one another with the said one faces thereof having the reinforcing means thereon being on the same side, connecting the extending portions of the wire mesh of the adjacent elements, and applying a continuous layer of mineral hydraulic mortar material to cover the said one faces of the adjacent elements and the mesh reinforcing means therein as well as the spaces therebetween to form the completed construction member.

2. A method as in claim 1 wherein the step of connecting the wire mesh means comprises interconnecting the reinforcing means of the two adjacent elements by passing pins through the reinforcing means and at least a portion of the laminate.

3. A method as in claim 1 the step of attaching the wire mesh reinforcing means comprise attaching a plurality of superimposed and interconnected metal reinforcing means to the outer face of each of the elements.

4. A method as in claim 1 wherein the step of interconnecting the reinforcing means of adjacent elements comprises bending the extending portions of at least the means of one element over the extending portions of the other.

5. A method as in claim 1 wherein the extending portions of the reinforcing means comprise a plurality of loops and the connecting step comprises inserting one loop within the other and bending at least one of the loops over the other.

6. A method as in claim 1 wherein the formation of each of the elements further comprises the step of c. applying cementitious material over the other face of the element opposite the said one face.

7. A method as in claim 6 wherein the step of applying the cementitious material comprises the step of applying a layer of mineral hydraulic mortar material.

8. A method as in claim 6 wherein the formation of each of the elements further comprises the step of:

d. attaching a wire mesh reinforcing means to the other face before the cementitious material is applied over the said other face.

* * * * *